US011577261B2

(12) United States Patent
Stafford

(10) Patent No.: US 11,577,261 B2
(45) Date of Patent: Feb. 14, 2023

(54) HIGH VELOCITY FLUID NOZZLE

(71) Applicant: Bryan Stafford, Hermosa Beach, CA (US)

(72) Inventor: Bryan Stafford, Hermosa Beach, CA (US)

( * ) Notice: Subject to any disclaimer, the term of this patent is extended or adjusted under 35 U.S.C. 154(b) by 318 days.

(21) Appl. No.: 16/720,500

(22) Filed: Dec. 19, 2019

(65) Prior Publication Data

US 2020/0238309 A1 Jul. 30, 2020

Related U.S. Application Data

(60) Provisional application No. 62/781,939, filed on Dec. 19, 2018.

(51) Int. Cl.
*B05B 1/34* (2006.01)
*F01D 9/02* (2006.01)

(52) U.S. Cl.
CPC ..... *B05B 1/34* (2013.01); *F01D 9/02* (2013.01); *F05D 2220/31* (2013.01); *F05D 2240/128* (2013.01)

(58) Field of Classification Search
CPC ... F01D 9/02; F01D 9/048; F01D 9/06; F05D 2220/31; F05D 2220/72; F05D 2240/128; F05D 2250/25; F05D 2270/20; B05B 1/005; B05B 1/34
See application file for complete search history.

(56) References Cited

U.S. PATENT DOCUMENTS 262,183 A * 8/1882 Hogan ..... B05B 1/3415 239/487
1,713,357 A * 5/1929 St Clair ..... F23D 11/24 239/501
2,776,862 A * 1/1957 Bloom ..... B05B 15/50 239/488
2010/0330521 A1* 12/2010 Krieger ..... F23D 11/107 239/406
2021/0404345 A1* 12/2021 Graves ..... F02K 9/97

* cited by examiner

*Primary Examiner* — Courtney D Heinle
*Assistant Examiner* — Danielle M. Christensen
(74) *Attorney, Agent, or Firm* — UltimatEdge IP Law Group, P.C.; Dean G. Stathakis

(57) ABSTRACT

A nozzle is provided for increasing the velocity of a fluid flowing therethrough, such as steam or other working fluid. The nozzle generally includes a body portion with a conical helical passage formed through the body portion to define an unlet port and an outlet orifice. The passage diameter can decreases continuously from the inlet port to the outlet orifice. Further, the conical helical passage can be a right-handed helix. To aid in manufacture and repair, the body can be divided into quadrants, where each plane of division passes through the center axis of the body portion. The present nozzle can be, for example, inserted into a steam turbine nozzle box as s retrofit for increasing the velocity of the steam incident on the turbine blades to increase turbine efficiency.

11 Claims, 3 Drawing Sheets

HIGH VELOCITY FLUID NOZZLE

BACKGROUND

The present invention relates to a fluid nozzle, and more particularly, to a nozzle for increasing the velocity of a working fluid flowing therethrough.

In many industrial applications, there is a desire to increase the velocity of fluids by various fluid control means, such as the application of a nozzle downstream of a high pressure fluid source, such as superheated steam from a boiler. Many existing nozzle rely primarily on a small orifice to increase velocity. However, current methods and tools may not increase velocity sufficiently and provide desired flow characteristics, which are needed to increase the efficiency of the nozzle and the system to which the nozzle is connected.

Thus, it is a desire to provide an improved nozzle that overcomes the deficiencies of existing nozzle technologies, such as inadequate outlet velocity and efficiency of operation.

SUMMARY

In one or more embodiments, a nozzle is provided for controlling a fluid flowing therethrough. The example nozzle can include a body portion with a fluid passage formed therethrough. The body portion has a center axis formed from a first face to a second face opposite the first face. The fluid passage is formed through the body portion from the first face to the second face, where the fluid passage begins at an inlet port on the first face and terminates at an outlet orifice on the second face, and where the fluid passage is configured to deliver the fluid from the inlet port to the outlet orifice. Additionally, the fluid passage is formed on a conical helix path through the body portion and is centered on and coiled about the center axis. Further, the inlet port has an inlet diameter that is greater than an outlet diameter of the outlet orifice.

In one or more optional embodiments, a passage diameter decreases from the inlet port to the outlet orifice. Further, the passage diameter can decrease continuously from the inlet port to the outlet orifice. Also, the passage diameter can decrease as a function of an arc length.

In one or more optional embodiments, the conical helix path is a left-handed helix or a right-handed helix.

In one or more optional embodiments, the body portion is made of a first body quadrant with a first portion of the fluid passage formed therethrough, a second body quadrant with a second portion of the fluid passage formed therethrough, a third body quadrant with a third portion of the fluid passage formed therethrough, and a fourth body quadrant with a fourth portion of the fluid passage formed therethrough. When the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage. Further, in one or more optional embodiments, the first body quadrant, the second body quadrant, the third body quadrant, and the fourth body quadrant can be self-locating and/or self-fixturing. Additionally, in one or more optional embodiments, the first body quadrant, the second body quadrant, the third body quadrant, and the fourth body quadrant are fastened together, welded together, adhered together, and/or banded together.

In one or more optional embodiments, the fluid is steam and the body is configured to be inserted into a steam turbine nozzle box for increasing the velocity of steam flowing therethrough.

In one or more embodiments, a nozzle is provided for controlling a fluid flowing therethrough. The example nozzle can include a body portion with a fluid passage formed therethrough. The body portion has a center axis formed from a first face to a second face opposite the first face. The fluid passage is formed through the body portion from the first face to the second face, where the fluid passage begins at an inlet port on the first face and terminates at an outlet orifice on the second face, where the fluid passage is configured to deliver the fluid from the inlet port to the outlet orifice. The fluid passage is formed on a conical helix path through the body portion and is centered on and coiled about the center axis. The inlet port has an inlet diameter that is greater than an outlet diameter of the outlet orifice and a passage diameter decreases from the inlet port to the outlet orifice.

In one or more optional embodiments, the passage diameter decreases continuously from the inlet port to the outlet orifice. Further, the conical helix path can be a right-handed helix.

In one or more optional embodiments, the body portion is made of a first body quadrant with a first portion of the fluid passage formed therethrough, a second body quadrant with a second portion of the fluid passage formed therethrough, a third body quadrant with a third portion of the fluid passage formed therethrough, and a fourth body quadrant with a fourth portion of the fluid passage formed therethrough. When the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage.

In one or more optional embodiments, the fluid is steam and the body is configured to be inserted into a steam turbine nozzle box for increasing the velocity of steam flowing therethrough.

In one or more embodiments, a nozzle is provided for controlling a fluid flowing therethrough. The example nozzle can include a body portion with a fluid passage formed therethrough. The body portion has a center axis formed from a first face to a second face opposite the first face. The fluid passage is formed on a conical helix path through the body portion from the first face to the second face centered on and coiled about the center axis, where the fluid passage begins at an inlet port on the first face and terminates at an outlet orifice on the second face, and where the inlet port has an inlet diameter that is greater than an outlet diameter of the outlet orifice and the passage diameter decreases continuously from the inlet port to the outlet orifice, and where the fluid passage is configured to deliver the fluid from the inlet port to the outlet orifice. The body portion is comprised of a first body quadrant with a first portion of the fluid passage formed therethrough, a second body quadrant with a second portion of the fluid passage formed therethrough, a third body quadrant with a third portion of the fluid passage formed therethrough, and a fourth body quadrant with a fourth portion of the fluid passage formed therethrough. When the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage.

In one or more optional embodiments, the conical helix path is a right-handed helix. Further, the first body quadrant, the second body quadrant, the third body quadrant, and the fourth body quadrant can be self-locating and/or self-fixturing. Additionally, the first body quadrant, the second body quadrant, the third body quadrant, and the fourth body quadrant can be fastened together, welded together, adhered together, and/or banded together. Also, the fluid can be steam and the body can be configured to be inserted into a steam turbine nozzle box for increasing the velocity of steam flowing therethrough.

LISTING OF REFERENCE NUMERALS

Figure 1:
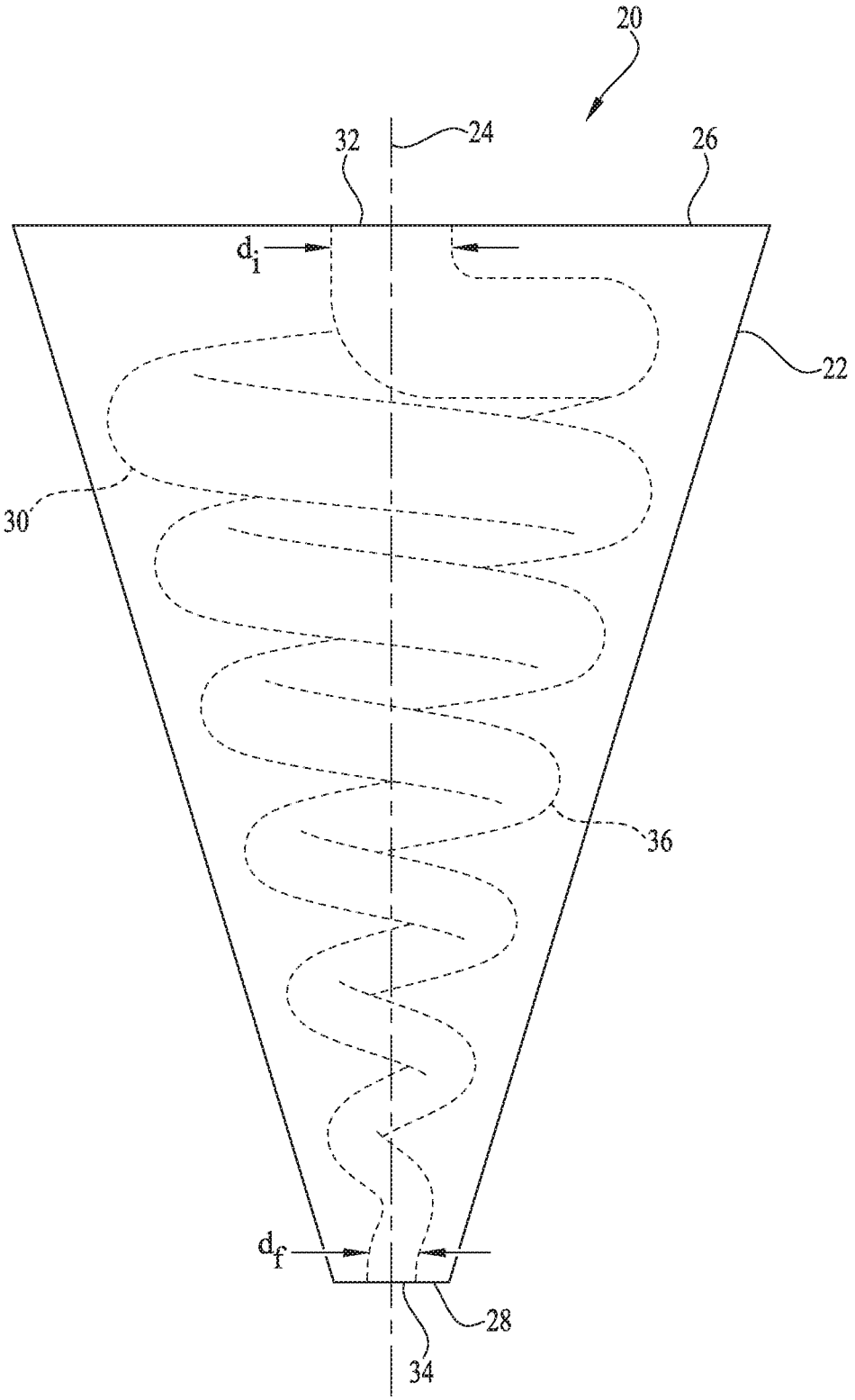
FIG. 1 is a side view of the present fluid nozzle, with the fluid passage formed through shown with hidden lines.
Figure 2:
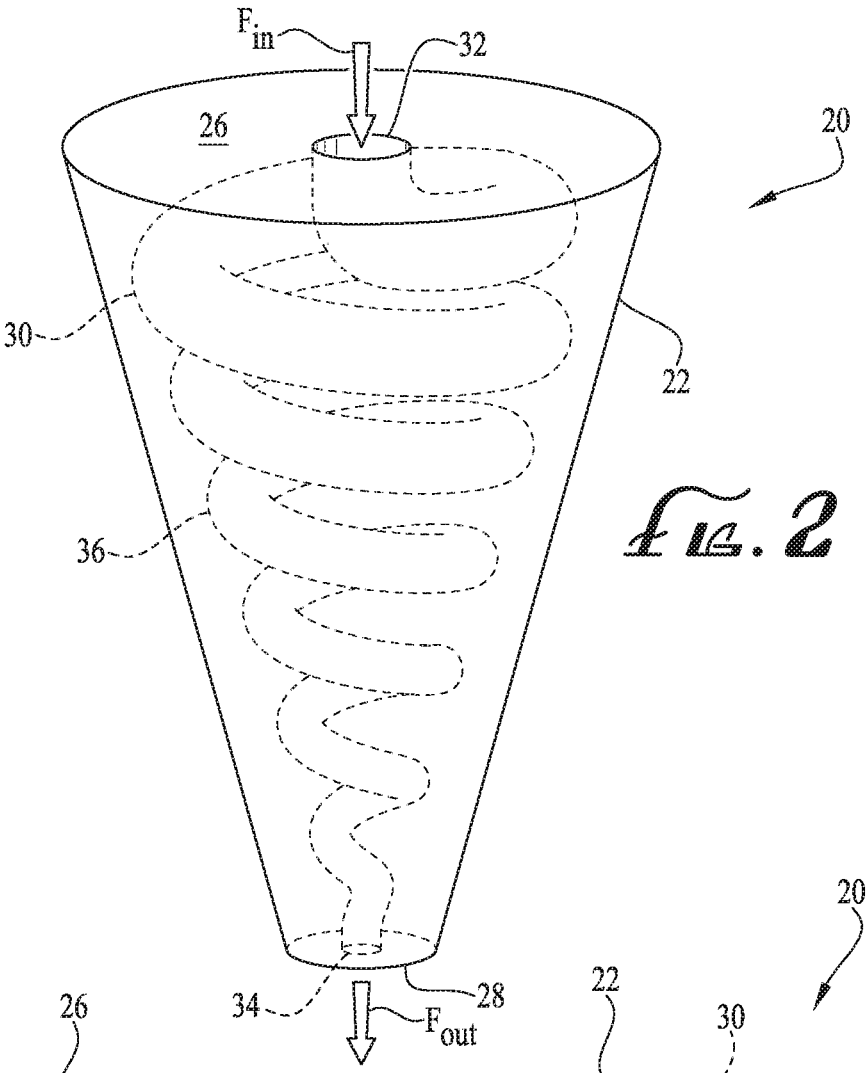
FIG. 2 is a perspective view of the fluid nozzle of FIG. 1.
Figure 3:
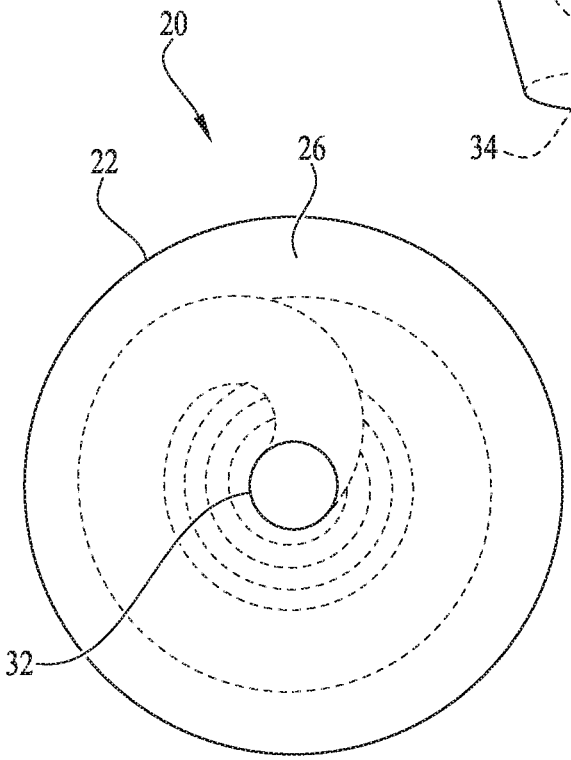
FIG. 3 is a top view of the fluid nozzle of FIG. 1.
Figure 4:
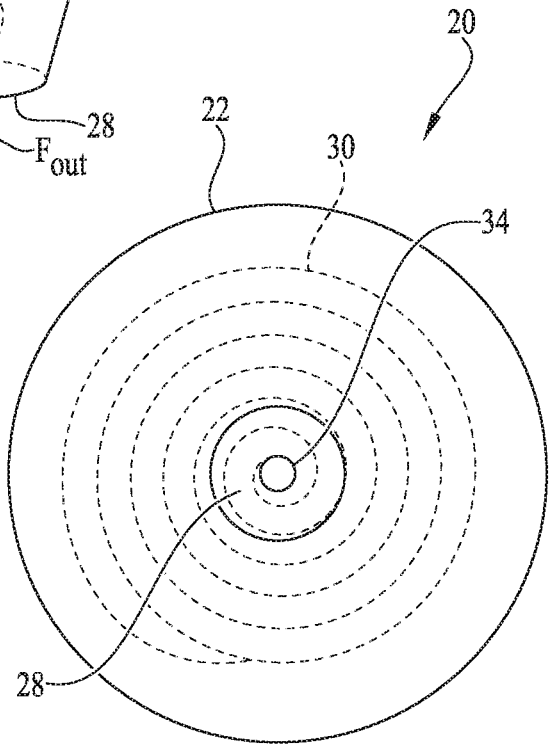
FIG. 4 is a bottom view of the fluid nozzle of FIG. 1.

| | |
|---|---|
| nozzle | 20 |
| body portion | 22 |
| center axis | 24 |
| first face | 26 |
| second face | 28 |
| fluid passage | 30 |
| inlet port | 32 |
| outlet orifice | 34 |
| conical helix path | 36 |
| first body quadrant | 38 |
| second body quadrant | 40 |
| third body quadrant | 42 |
| fourth body quadrant | 44 |
| first portion | 46 |
| second portion | 48 |
| third portion | 50 |
| fourth portion | 52 |
| fluid | F |

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

FIGS. 1-4 illustrate a first example embodiment of the present nozzle 20. The nozzle 20 generally includes a body 22 (or body portion) with a fluid passage 30 formed through the body portion 22. Although exterior shape of the body 22 is illustrated as a frustoconical shape (e.g., a truncated cone), the exterior shape can vary according to the application and is not restricted to the illustrated shape. For example, the body 22 can be configured to attach (e.g., by threaded engagement, quick fit, clamping or other known attachment means) to a fluid source. Alternatively, the body 22 can be configured to fit within a receiving chuck or other enclosure or box. For example, U.S. Pat. No. 6,631,858, issued on Oct. 14, 2003 to Farineau et al. and U.S. Patent Application Publication No. US 2008/0056891, published on Mar. 6, 2008, to Hamlin et al., each of which are herein incorporated by reference in their entirety, each illustrate a steam turbine nozzle box with inlet nozzles with which the present nozzle 20 can fit within, replace, or be fitted in another appropriate location for the purpose of increasing the velocity of the steam being injected onto the blades of the turbine. In one or more examples, a similarly constructed box with the present nozzle 20 fitted instead of the illustrated nozzles.

Looking still at FIGS. 1-4, the fluid passage 30 is a conical helix passage 36 (i.e., where the passage 30 follows or substantially a spiral path on a conic surface) centered on and spiraled about the center axis 24. The radii of the bands of the helix passage 36 are generally decreasing, as measured from the first face 26 to the second face 28. This decrease in radii can be constant (e.g., exactly following the slope of the conic surface) or may vary somewhat from the exact shape (e.g., slightly bow out—spherical boundary—or in, or the like). Further, the pitch of the helix passage 36 (i.e., the height of one complete helix turn) may be constant from the first face 26 to the second face 28 or may vary. For example, the pitch of the helix passage 36 may be increased near the outlet orifice 34, so that the exiting fluid F can be directed toward or at an angle incident to a particular target. Further, although a right-handed helix is illustrated (i.e., when viewed from FIG. 3, the helix is spiraling counterclockwise), a left-handed helix is also possible. The various properties of the helix passage 36 can be varied according to fluid dynamic demands of the application, the working fluid, and other parameters of the system. For example, if the density, viscosity, etc. of the fluid F were different, the design of the passage 30 may also change.

As is illustrated in at least FIG. 1, the passage diameter d decreases from the inlet port 32 on the first face 26 to the outlet orifice 34 on the second face 28. At the inlet port 32 the passage diameter $d_i$ is at its largest; and at the outlet orifice 34 the passage diameter $d_r$ is at its smallest. In one or more embodiments, the passage diameter $d_i$ can be at least 1.25 times larger than the passage diameter $d_i$, or the passage diameter $d_i$ can be at least 1.5 times larger than the passage diameter $d_i$, or the passage diameter $d_i$ can be at least 1.25 times larger than the passage diameter $d_i$, or the passage diameter $d_i$ can be at least 1.75 times larger than the passage diameter $d_i$, or the passage diameter $d_i$ can be at least 2 times larger than the passage diameter $d_i$, or the passage diameter $d_i$ can be at least 2.5 times larger than the passage diameter $d_i$, or the passage diameter $d_i$ can be at least 3 times larger than the passage diameter $d_i$, or the passage diameter $d_i$ can be at least 3.5 times larger than the passage diameter $d_i$, or the passage diameter $d_i$ can be at least 4 times larger than the passage diameter $d_i$, or the passage diameter $d_i$ can be at least 5 times larger than the passage diameter $d_i$, or the passage diameter $d_i$ can be at least 6 times larger than the passage diameter $d_i$, or the passage diameter $d_i$ can be at least 8 times larger than the passage diameter $d_i$, or the passage diameter $d_i$ can be at least 10 times larger than the passage diameter $d_i$.

Of course the outlet orifice 34 diameter maybe made much smaller than the passage diameter immediately upstream (e.g., a step or sudden decrease in diameter at the outlet unrelated to the generally decreasing diameter of the passage 30). The passage 30 diameter may be change gradually and/or continuously (e.g., if an imaginary passage 30 were to be pulled straight, it would form a cone) along its arc length (i.e., the length of a circular helix). Alternatively the diameter of the passage 30 can vary and be non-constant. For example, it may be a desire to maintain a constant diameter passage 30 in one section, while reducing the diameter in other sections of the passage 30. The number of coils may vary according to the design needs. For example, the number of coils can be greater or equal to 0.5 coils, or the number of coils can be greater or equal to 1 coils, or the number of coils can be greater or equal to 1.5 coils, or the number of coils can be greater or equal to 2 coils, or the number of coils can be greater or equal to 2.5 coils, or the number of coils can be greater or equal to 3 coils, or the number of coils can be greater or equal to 3.5 coils, or the number of coils can be greater or equal to 4 coils, or the number of coils can be greater or equal to 5 coils, or the number of coils can be greater or equal to 6 coils, or the number of coils can be greater or equal to 7 coils, or the number of coils can be greater or equal to 10 coils, or the number of coils can be greater or equal to 15 coils.

The purpose of the decreasing passage 30 diameter d along with the conical helix path 36 of the passage 30 is to effectively and efficiently increase the velocity of the working fluid F to far higher speeds than a general decrease in orifice diameter.

Figure 5:
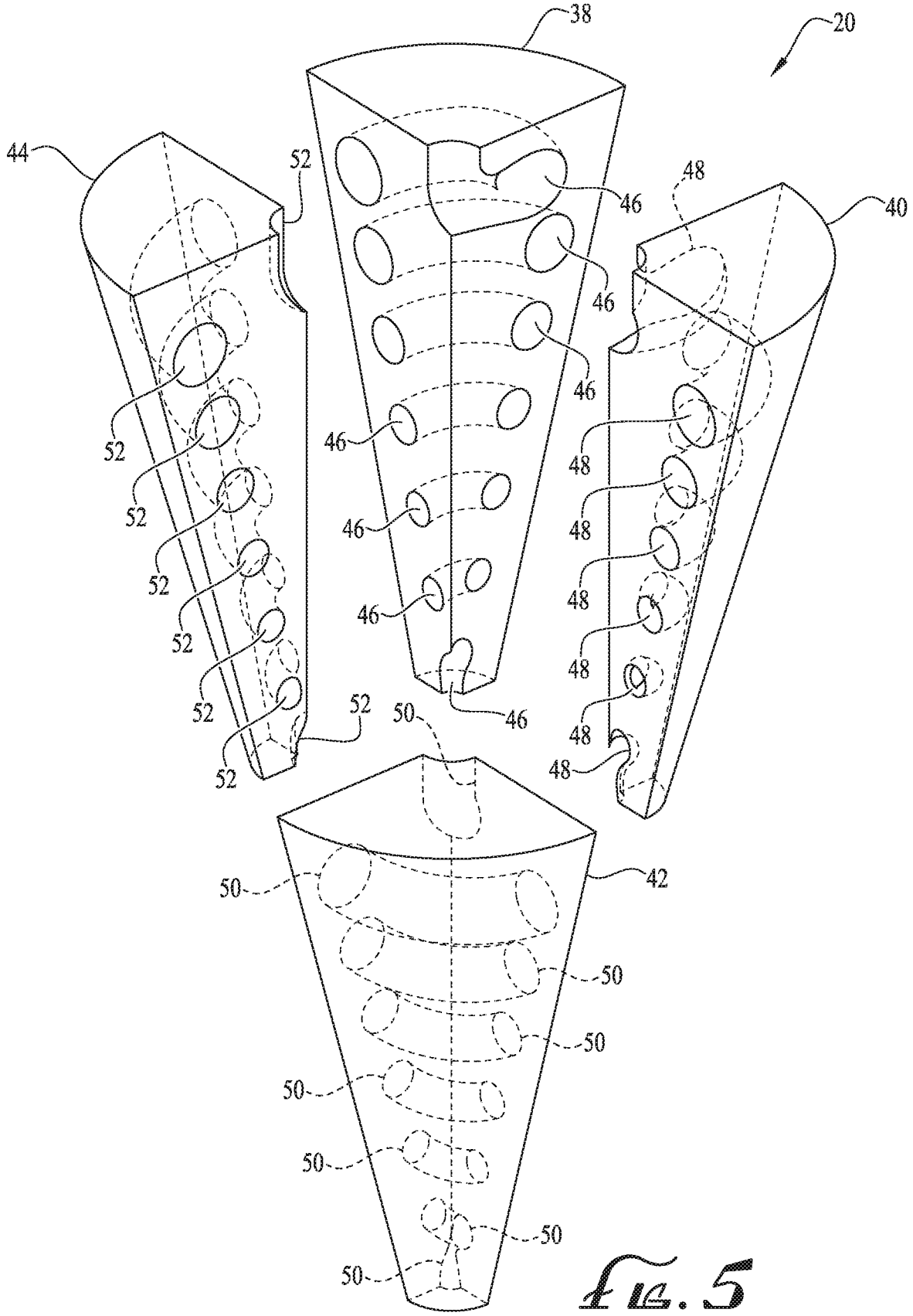
FIG. 5 is an exploded view of a embodiment of the fluid nozzle, showing an example assembly.

Looking at FIG. 5, one example manufacturing technique is illustrated. where the body 22 of the nozzle 20 is divided into four sections (e.g., by bisecting the body with two planes arranged planar perpendicular to one another and intersecting each other at the center axis 24). Of course, in manufacturing, each section can be made separate from the other, and the intersecting planes simply illustrate how the sections fit together to form the body 22.

The example body 22 is comprised of a first body quadrant 38, a second body quadrant 40, a third body quadrant 42, and a fourth body quadrant 44, when placed together form the whole body 22. Each of these quadrants 38, 40, 42, and 44 are machined (or molded, printed, etc.) separately, which provides sufficient access to permit a CNC milling machine or the like to mill out segments of the passage 30 which are normally inaccessible to machining when not divided. For example, the first body quadrant 38 has formed therein the first portion 46 of the passage 30, the second body quadrant 40 has formed therein the second portion 48 of the passage 30, the third body quadrant 42 has formed therein the first portion 50 of the passage 30, and the fourth body quadrant 44 has formed therein the first portion 52 of the passage 30.

When the quadrants 38, 40, 42, and 44 are positioned together such that the passage portions 46, 48, 50 and 52 are aligned, the full passage 30 is formed. Since alignment is critical to avoid steps within the passage 30, various known fixturing and alignment means can be provided, as is known in the art. For example, the quadrants 38, 40, 42, and 44 can include complementary pins or bosses and holes into which the pins or bosses fit.

The present application claims benefit from U.S. provisional application No. 62/781,939, filed on Dec. 19, 2018, which is incorporated herein by reference in its entirety.

Although the apparatus and methods described herein are described in context of a nozzle for use with steam turbines, it is understood that the apparatus and methods are not limited to nozzle inserts or steam turbines. Likewise, the nozzle components illustrated are not limited to specific embodiments described herein, but rather, components of the nozzle can be utilized independently and separately from other components described herein.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. A nozzle for controlling a fluid flowing therethrough, the nozzle comprising:

a body portion having a center axis formed from a first face to a second face opposite the first face; and a fluid passage formed through the body portion from the first face to the second face, the fluid passage beginning at an inlet port on the first face and terminating at an outlet orifice on the second face, the fluid passage being configured to deliver the fluid from the inlet port to the outlet orifice, the fluid passage is formed on a conical helix path through the body portion and is centered on and coiled about the center axis, the inlet port has an inlet diameter that is greater than an outlet diameter of the outlet orifice, and the passage diameter decreases continuously from the inlet port to the outlet orifice;

wherein the body portion is an assembly of four separate parts comprising a first body quadrant with a first portion of the fluid passage formed therethrouqh, a second body quadrant with a second portion of the fluid passage formed therethrouqh, a third body quadrant with a third portion of the fluid passage formed therethrough, and a fourth body quadrant with a fourth portion of the fluid passage formed therethrough;

and wherein, when the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage.

2. The nozzle of claim 1 wherein the passage diameter decreases as a function of an arc length of the conical helix path.

3. The nozzle of claim 1 wherein the conical helix path is a left-handed helix.

4. The nozzle of claim 1 wherein the conical helix path is a right-handed helix.

5. The nozzle of claim 1 wherein the fluid is steam and the body is configured to be inserted into a steam turbine nozzle box for increasing the velocity of steam flowing therethrough.

6. A nozzle for controlling a fluid flowing therethrough, the nozzle comprising:

a body portion having a center axis formed from a first face to a second face opposite the first face; and a fluid passage formed through the body portion from the first face to the second face, the fluid passage beginning at an inlet port on the first face and terminating at an outlet orifice on the second face, the fluid passage being configured to deliver the fluid from the inlet port to the outlet orifice, the fluid passage is formed on a conical helix path through the body portion and is centered on and coiled about the center axis, the inlet port has an inlet diameter that is greater than an outlet diameter of the outlet orifice;

wherein the body portion is an assembly of four separate parts comprising a first body quadrant with a first portion of the fluid passage formed therethrough, a second body quadrant with a second portion of the fluid passage formed therethrough, a third body quadrant with a third portion of the fluid passage formed therethrough, and a fourth body quadrant with a fourth portion of the fluid passage formed therethrough;

and wherein, when the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage.

7. The nozzle of claim 6 wherein the passage diameter decreases continuously from the inlet port to the outlet orifice.

8. The nozzle of claim 6 wherein the conical helix path is a right-handed helix.

9. The nozzle of claim 6 wherein the fluid is steam and the body is configured to be inserted into a steam turbine nozzle box for increasing the velocity of steam flowing therethrough.

10. A nozzle for controlling a fluid flowing therethrough, the nozzle comprising:

a body portion having a center axis formed from a first face to a second face opposite the first face;

a fluid passage formed on a conical helix path through the body portion from the first face to the second face centered on and coiled about the center axis, the fluid passage beginning at an inlet port on the first face and terminating at an outlet orifice on the second face, the inlet port has an inlet diameter that is greater than an outlet diameter of the outlet orifice and a passage diameter decreases continuously from the inlet port to the outlet orifice, the fluid passage being configured to deliver the fluid from the inlet port to the outlet orifice;

wherein the body portion is an assembly of four separate parts comprised of a first body quadrant with a first portion of the fluid passage formed therethrough, a second body quadrant with a second portion of the fluid passage formed therethrough, a third body quadrant with a third portion of the fluid passage formed therethrough, and a fourth body quadrant with a fourth portion of the fluid passage formed therethrough; and wherein, when the first body quadrant, the second body quadrant, the third body quadrant, and the fourth body quadrant are assembled about the center axis, the first portion of the fluid passage, the second portion of the fluid passage, the third portion of the fluid passage, and the fourth portion of the fluid passage are configured to be aligned to form the fluid passage;

and wherein, the fluid is steam and the body is configured to be inserted into a steam turbine nozzle box for increasing the velocity of steam flowing therethrough.

11. The nozzle of claim 10 wherein the conical helix path is a right-handed helix.

* * * * *